US008757440B2

(12) United States Patent
Ouillette

(10) Patent No.: US 8,757,440 B2
(45) Date of Patent: Jun. 24, 2014

(54) CONTAINER

(75) Inventor: Paul G. Ouillette, Noblesville, IN (US)

(73) Assignee: Dow AgroSciences, LLC., Indianapolis, IN (US)

( * ) Notice: Subject to any disclaimer, the term of this patent is extended or adjusted under 35 U.S.C. 154(b) by 404 days.

(21) Appl. No.: 13/033,971

(22) Filed: Feb. 24, 2011

(65) Prior Publication Data

US 2011/0215136 A1 Sep. 8, 2011

Related U.S. Application Data

(60) Provisional application No. 61/308,346, filed on Feb. 26, 2010.

(51) Int. Cl.
*B65D 35/56* (2006.01)

(52) U.S. Cl.
USPC ..... 222/105; 222/183; 222/382; 222/464.7; 229/199; 229/117.3; 229/117.35; 220/23.89; 220/62.2; 220/495.06; 220/626

(58) Field of Classification Search
USPC ..... 229/117.3, 199, 117.25–117.35; 222/92–96, 105–107, 183, 185.1, 204, 222/382, 460–462, 464.1, 464.7; 220/23.83–23.91, 1.6, 62.19–62.22, 220/495.01, 495.05–495.06, 495.1, 507, 220/509–519, 626–627, 625
See application file for complete search history.

(56) References Cited

U.S. PATENT DOCUMENTS

| | | | | |
|---|---|---|---|---|
| 301,753 | A * | 7/1884 | Porter | 220/23.87 |
| 2,861,718 | A * | 11/1958 | Winzen | 222/105 |
| 3,171,571 | A * | 3/1965 | Daniels | 222/94 |
| 3,172,570 | A * | 3/1965 | Lipschutz | 222/105 |
| 3,237,760 | A * | 3/1966 | De Remer et al. | 206/597 |
| 4,083,486 | A | 4/1978 | Bergstein | |
| 4,120,420 | A * | 10/1978 | Dirksing | 229/117.3 |
| 4,660,733 | A * | 4/1987 | Snyder et al. | 220/634 |
| 4,770,338 | A | 9/1988 | Tatusch | |
| 5,265,753 | A | 11/1993 | Moorman | |
| 5,351,849 | A * | 10/1994 | Jagenburg et al. | 229/117.3 |
| 5,474,203 | A * | 12/1995 | Baker | 229/117.27 |
| 5,544,777 | A * | 8/1996 | Watson | 220/4.13 |
| 5,562,227 | A * | 10/1996 | Takezawa et al. | 229/117.13 |
| 5,897,012 | A | 4/1999 | Sortwell | |
| 6,245,555 | B1 * | 6/2001 | Curtis | 435/289.1 |
| 6,253,993 | B1 | 7/2001 | Lloyd et al. | |
| 6,648,201 | B1 * | 11/2003 | Marinaro et al. | 227/95 |
| 7,077,309 | B2 | 7/2006 | Andrews | |
| 7,337,908 | B2 | 3/2008 | Dedmon | |
| 7,828,174 | B2 * | 11/2010 | Doehnert et al. | 222/105 |
| 8,025,208 | B2 * | 9/2011 | Wisecarver et al. | 229/117.3 |
| 2002/0056725 | A1 * | 5/2002 | Wilcox et al. | 222/95 |

(Continued)

OTHER PUBLICATIONS

International Search Report, Apr. 19, 2011.

(Continued)

*Primary Examiner* — Paul R Durand
*Assistant Examiner* — Andrew P Bainbridge
(74) *Attorney, Agent, or Firm* — C. W. Arnett; Faegre Baker Daniels LLP

(57) ABSTRACT

A container is disclosed. The container includes a fillable bladder in an interior of an enclosure of the container. The container has a sump region which assists in the removal of a pumpable product from the fillable bladder.

43 Claims, 10 Drawing Sheets

(56) References Cited

U.S. PATENT DOCUMENTS

| | | | | |
|---|---|---|---|---|
| 2003/0160092 | A1* | 8/2003 | Philips et al. | 229/122.32 |
| 2005/0109827 | A1 | 5/2005 | Martin | |
| 2006/0180643 | A1 | 8/2006 | Stephenson | |
| 2010/0102112 | A1 | 4/2010 | Ouillette | |

OTHER PUBLICATIONS

Written Opinion of the International Searching Authority, Apr. 19, 2011.
International Paper SpaceKraft Package, available at least as early as Feb. 25, 2008, at http://www.spacekraft.com/products/liquids.htm.
Smurfit Kappa Jerribox, PDF available at least as early as Feb. 29, 2008, at http://www.smurfitkappa-jerribox.com.
Scholle Jerribox, PDF available at least as early as Mar. 5, 2008, at www.scholle.com/jerribox.
Micro Matic Drum, PDF available at least as early as Nov. 3, 2009, at http://www.industrial.micromatic.com/products/drum/index.htm.
Micro Matic Valve, PDF available at least as early as Nov. 3, 2009, at http://www.industrial.micromatic.com/products/valve/index.htm.
Micro Matic Refillable Drum, PDF available at least as early as Nov. 3, 2009, at http://www.industrial.micromatic.com/applications/index.htm.
Micro Matic Farmtainer, PDF available at least as early as Nov. 3, 2009, at http://www.industrial.micromatic.com/applications/index.htm.
Micro Matic, DV-Drum Valve Comprehensive Instructions Manual, available at http://www.industrial.micromatic.com, 2007.

* cited by examiner

CONTAINER

CROSS REFERENCE TO RELATED APPLICATIONS

This application claims the benefit of U.S. Provisional Patent Application Ser. No. 61/308,346 filed Feb. 26, 2010, which is expressly incorporated by reference herein.

FIELD

The present invention relates to containers for holding a pumpable product and in particular to containers having a fillable bladder and an enclosure supporting the fillable bladder.

BACKGROUND

Containers including a fillable bladder and a foldable enclosure are known. One such container is the JERRIBOX brand container available from Scholle Packaging having offices at 200 West North Avenue, in Northlake, Ill. 60164.

SUMMARY

In an exemplary embodiment of the present disclosure, a container with a sump is provided.

In another exemplary embodiment of the present disclosure, a container is provided. The container comprising an enclosure including a bottom portion, a top portion, and a plurality of sides which bound an interior of the enclosure, and a fillable bladder positioned within the enclosure. The enclosure including a sump region proximate the bottom portion of the enclosure. An interior of the fillable bladder being accessible through an opening in the enclosure proximate the top portion of the enclosure, wherein a first horizontal cross-sectional area of the fillable bladder located in the sump region of the enclosure is smaller than a second horizontal cross-sectional area of the fillable bladder. The second horizontal cross-sectional area being above the first horizontal cross-sectional area and outside of the sump region of the enclosure.

In an example, the sump region is formed by a plurality of components stacked together. Each of the components having an opening provided therein into which the fillable bladder extendso. In a variation thereof, a cross-sectional area of the opening of a first component of the plurality of components is smaller than a cross-sectional area of the opening of a second component of the plurality of components. The first component of the plurality of components being positioned between the bottom of the enclosure and the second component of the plurality of components. In a further variation, the sump region centers a bottom portion of the fillable bladder under the opening in the enclosure proximate the top portion of the enclosure. In another variation, the openings in the plurality of components of the sump region are circular. In yet another variation, the cross-sectional area of the first component of the plurality of components is about 12 percent of the cross-sectional area of the second component of the plurality of components. In still another variation, the cross-sectional area of the first component of the plurality of components is less than about 50 percent of the cross-sectional area of the second component of the plurality of components.

In another example, the container further comprises a sleeve member which is positioned between the fillable bladder and the enclosure. The sleeve member keeping the fillable bladder spaced apart from the plurality of sides of the enclosure. In a variation thereof, a plurality of gaps are provided between the sleeve member and the plurality of sides of the enclosure. In a further variation thereof, a plurality of posts are positioned in the plurality of gaps to strengthen the sleeve member. In yet a further variation, the plurality of gaps are positioned in a plurality of corners formed by the plurality of sides of the enclosure. In still another variation, the plurality of sides of the enclosure form a quadrilateral within a horizontal plane and the sleeve member is an octagon within the horizontal plane. In yet still another variation, the sleeve member is a non-regular octagon within the horizontal plane. In still a further variation, the enclosure and the sleeve member are made of paperboard. In yet still another variation, the fillable bladder is suspended from a support member which rests on top of the sleeve member. In a further variation, the sump region is formed by a plurality of components stacked together, each of the components having an opening provided therein into which the fillable bladder extends. In yet a further variation, a cross-sectional area of the opening of a first component of the plurality of components is smaller than a cross-sectional area of the opening of a second component of the plurality of components. The first component of the plurality of components being positioned between the bottom of the enclosure and the second component of the plurality of components. In a further variation thereof, the sump region centers a bottom portion of the fillable bladder under the opening in the enclosure proximate the top portion of the enclosure. In yet another variation, the openings in the plurality of components of the sump region are circular. In still another variation, the cross-sectional area of the first component of the plurality of components is about 12 percent of the cross-sectional area of the second component of the plurality of components. In a further variation, the cross-sectional area of the first component of the plurality of components is less than about 50 percent of the cross-sectional area of the second component of the plurality of components. In still another variation, the plurality of components are positioned within the sleeve member. In yet still another variation, the plurality of components are made of paperboard.

Additional features and advantages of the present invention will become apparent to those skilled in the art upon consideration of the following detailed description of the illustrative embodiments exemplifying the best mode of carrying out the invention as presently perceived.

BRIEF DESCRIPTION OF THE DRAWINGS

The detailed description of the drawings particularly refers to the accompanying figures in which.

Corresponding reference characters indicate corresponding parts throughout the several views. The drawings are proportional except for block elements or otherwise noted.

DETAILED DESCRIPTION OF THE DRAWINGS

The embodiments of the invention descried herein are not intended to be exhaustive or to limit the invention to the precise forms disclosed. Rather, the embodiments selected for description have been chosen to enable one skilled in the art to practice the invention. Although the disclosure is described as a container having a fillable bladder and an enclosure it should be understood that the concepts presented herein may be used in various applications and should not be limited to use in connection with a fillable bladder and enclosure.

Figure 1:
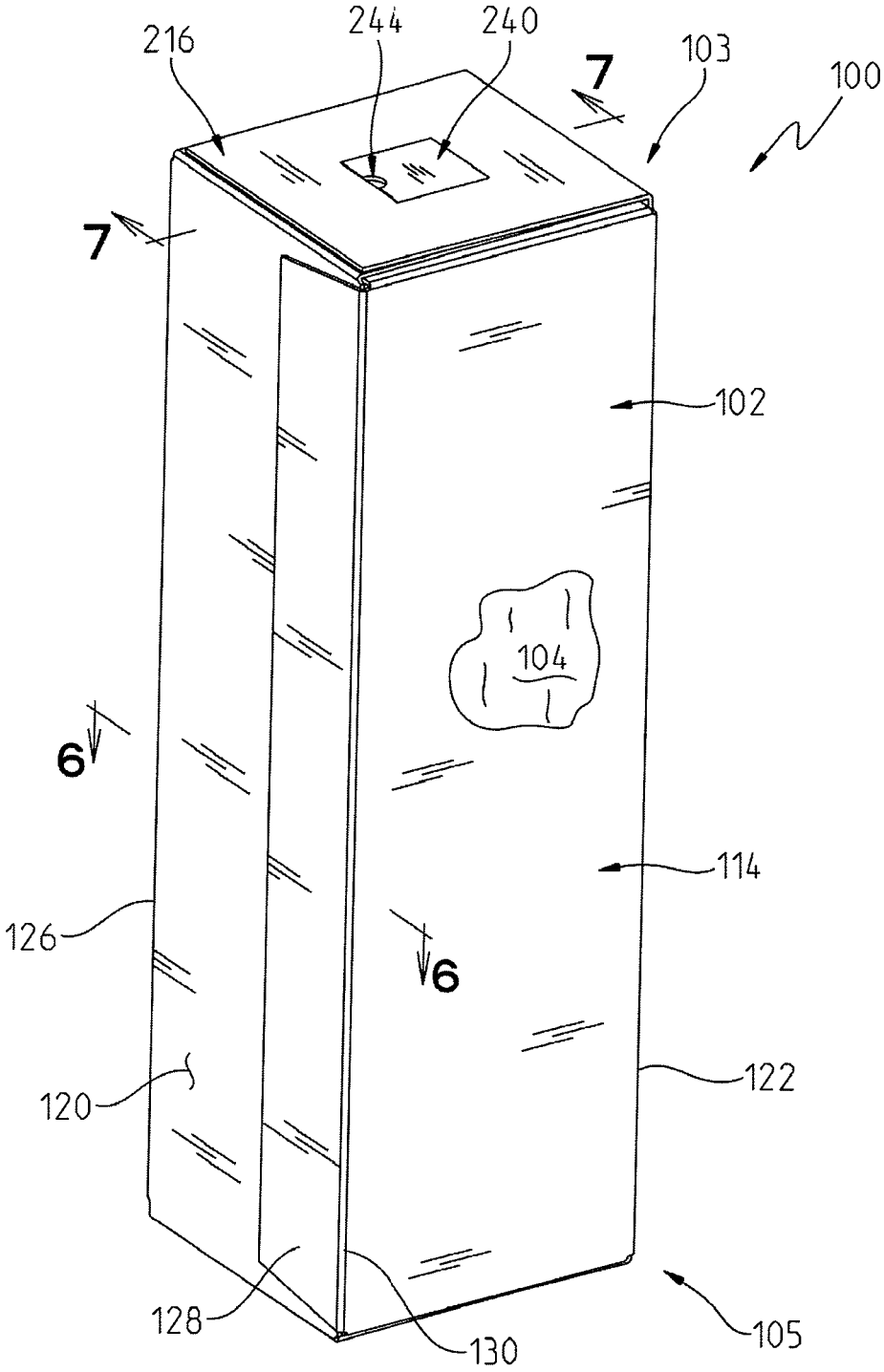
FIG. 1 illustrates a perspective view of a container including an enclosure having a fillable bladder positioned therein.

Referring to FIG. 1, a container 100 is shown having an enclosure 102 and a fillable bladder 104. In the illustrated embodiment, enclosure 102 is made from a single foldable component 106 (see FIG. 3) and fillable bladder 104 is a bladder made from a foldable material. Fillable bladder 104 is disposed within an interior 101 (see FIG. 7) of enclosure 102. In one embodiment, fillable bladder 104 may be a rigid bladder, such as a plastic jug or other suitable types of bladders.

Figure 7:
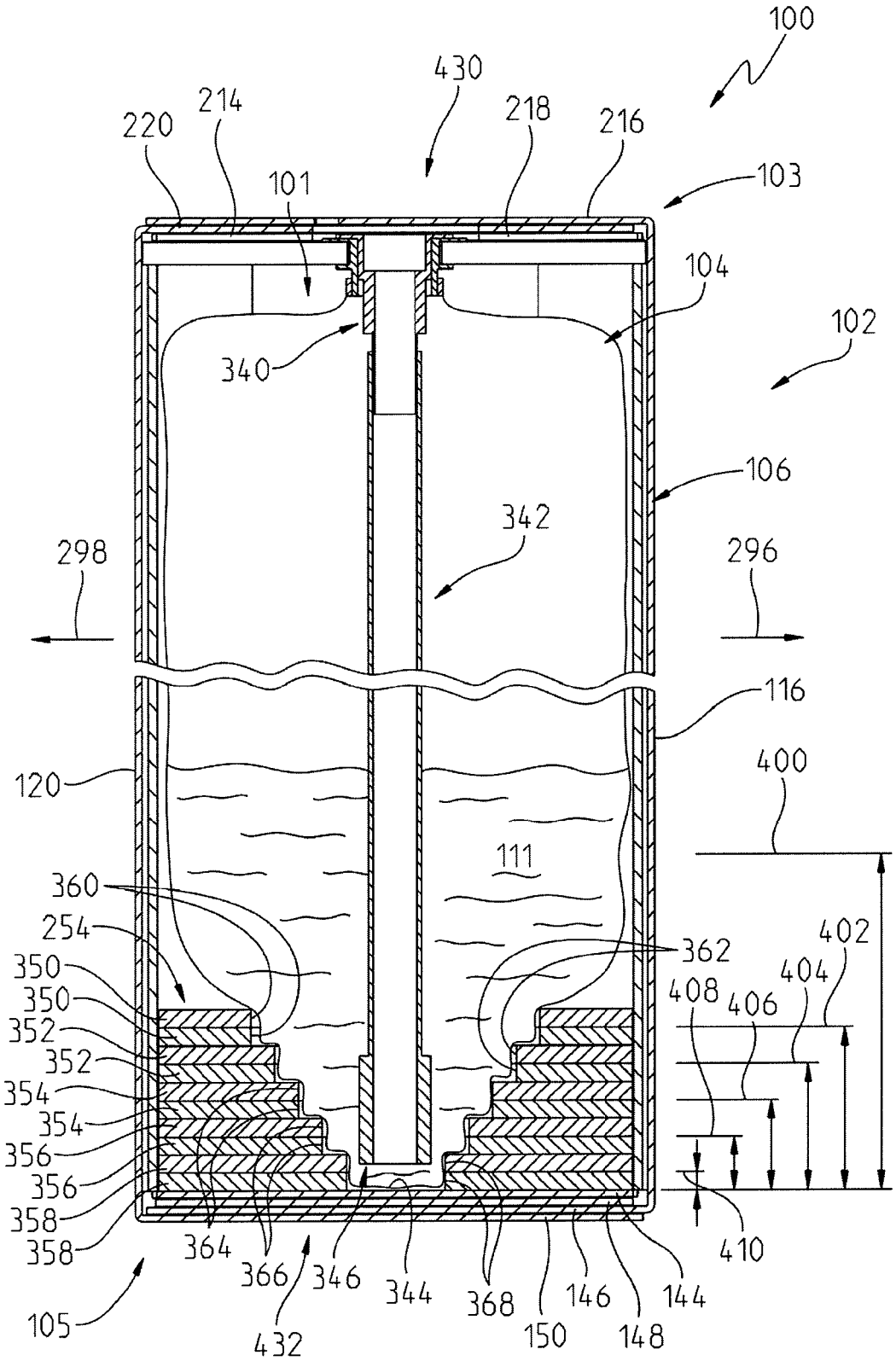
FIG. 7 illustrates a sectional view taken along lines 7-7 in FIG. 1.

Fillable bladder 104 is a flexible fillable bladder that houses a pumpable product 111 (see FIG. 7). The pumpable product 111 does not contact enclosure 102 directly, but rather is contained by fillable bladder 104. Exemplary types of pumpable products 111 include liquids, gels, granular material, and other materials which may be pumped by a pump. Pumpable product 111 may include liquids, granular materials, flowable materials, liquid pesticides, solid or granular pesticides, herbicides, insecticides, fungicides, seeds, clay, other types of pumpable agricultural materials, and other types of non-agricultural materials.

Enclosure 102 has a top portion 103 and a bottom portion 105. In one embodiment, enclosure 102 may be formed from multiple components which are assembled together to form the enclosure. Exemplary components include foldable components and rigid components. In one embodiment, foldable component 106 is a single piece of corrugated paperboard. In one embodiment, the single piece of corrugated paperboard includes multiple layers of corrugated paperboard. In one example, the single piece of corrugated paperboard includes two layers of corrugated paperboard. In one embodiment, reinforced tape is integrated into one or more layers of the corrugated material to improve bulge resistance.

Single foldable component 106, in one embodiment, has a width of about 64.125 inches (including a 6 inch side flap 128) and an unfolded height of about 79.125 inches with the distance between a third bottom fold line 158 and a third top fold line 228 being about 50.125 inches. Single foldable component 106 is made of multiple layers of corrugated paperboard. In one embodiment, single foldable component 106 is a two layer foldable component and has a BC flute.

In one embodiment, enclosure 102 has a moisture resistant, but not waterproof, coating applied. In one embodiment, the moisture resistant coating is applied to the exterior surfaces of enclosure 102.

In one embodiment, foldable component 106 is made of multiple components which are coupled together. Further, in one embodiment, enclosure 102 includes components having different material types, such as single wall paperboard, double wall paperboard, and plastic material.

Figure 3:
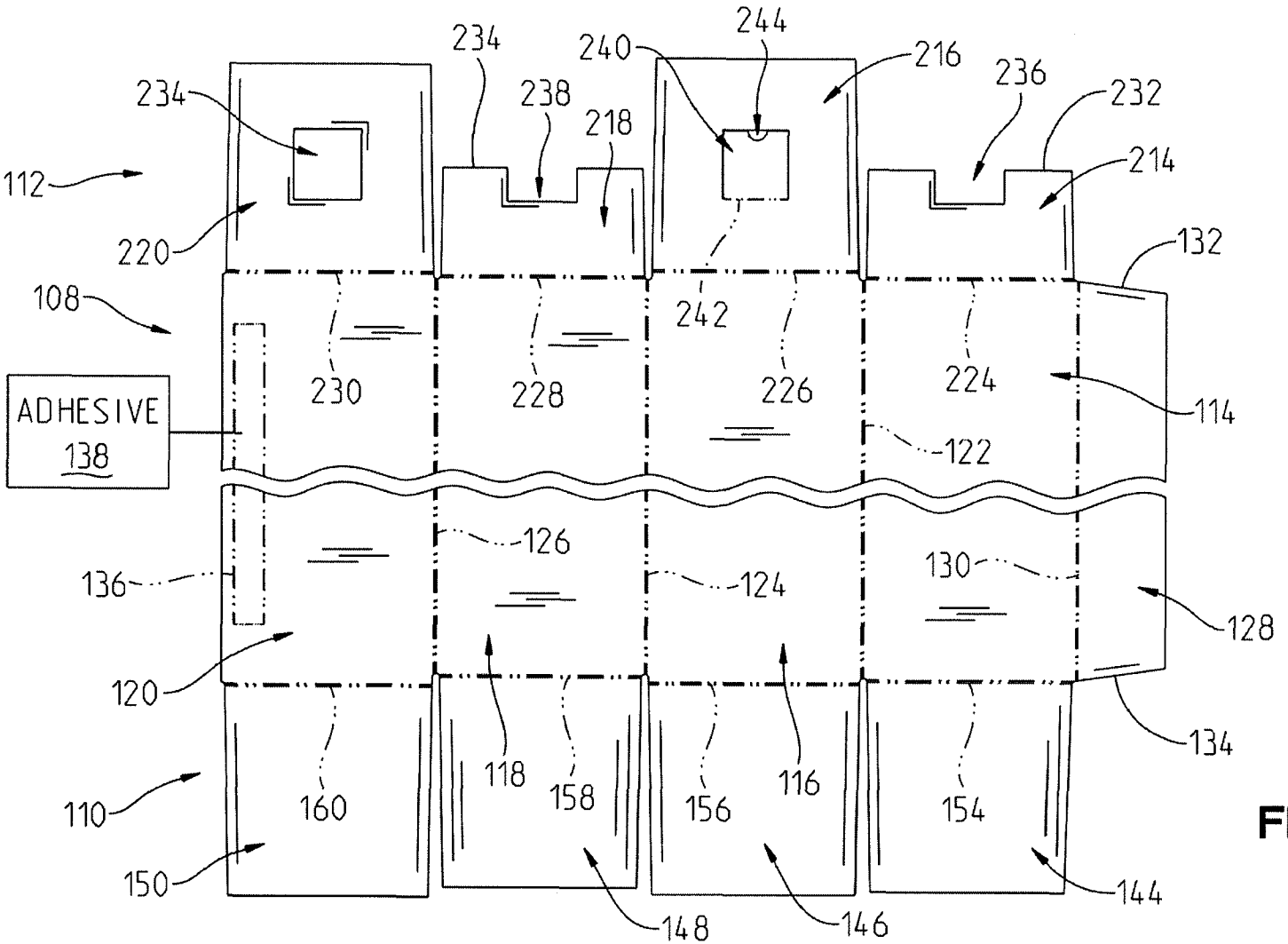
FIG. 3 illustrates a plan view of a single foldable component used to construct the enclosure of FIG. 2.

Referring to FIG. 3, foldable component 106 includes a plurality of sides 108, a plurality of bottom flaps 110, and a plurality of top flaps 112. Plurality of sides 108 includes a first side 114, a second side 116, a third side 118, and a fourth side 120. Although four sides are illustrated, plurality of sides 108 may include less than four sides or more than four sides. First side 114 is foldable relative to second side 116 at a first fold line 122. Second side 116 is foldable relative to third side 118 at a second fold line 124. Third side 118 is foldable relative to fourth side 120 at a third fold line 126.

A side flap 128 is foldable relative to first side 114 at a fourth fold line 130. Upper and lower edges 132 and 134 of side flap 128 are tapered away from first side 114. Referring to FIG. 1, side flap 128 overlaps a portion 136 (see FIG. 3) of fourth side 120. In one embodiment, a width of side flap 128 is about one-third of a width of fourth side 120.

Returning to FIG. 2, foldable component 106 is shown with first side 114 folded relative to second side 116 at first fold line 122, second side 116 folded relative to third side 118 at second fold line 124, third side 118 folded relative to fourth side 120 at third fold line 126, and side flap 128 folded relative to first side 114 at fourth fold line 130. Side flap 128 overlaps portion 136 of fourth side 120 and is visible from the exterior of enclosure 102. Further, side flap 128 is secured such that it generally does not move relative to fourth side 120. In one embodiment, side flap 128 is secured with tape. In one embodiment, an adhesive 138 is positioned between side flap 128 and portion 136 of fourth side 120. Exemplary adhesive include water resistant adhesives. In one embodiment, at least one of a lower surface of side flap 128 and portion 136 of fourth side 120 includes perforations which permit the adhesive to pass into an interior portion of at least one of side flap 128 and fourth side 120 as disclosed in U.S. Provisional Patent Application Ser. No. 61/107,799, titled CONTAINER, filed Oct. 23, 2008 and U.S. patent application Ser. No. 12/571,859, filed Oct. 1, 2009, the disclosures of which are expressly incorporated by reference herein.

Returning to FIG. 3, single foldable component 106 includes a first bottom flap 144, a second bottom flap 146, a third bottom flap 148, and a fourth bottom flap 150 which extend from first side 114, second side 116, third side 118, and fourth side 120, respectively. First bottom flap 144, second bottom flap 146, third bottom flap 148, and fourth bottom flap 150 are foldable relative to first side 114, second side 116, third side 118, and fourth side 120 along first bottom fold line 154, second bottom fold line 156, third bottom fold line 158, and fourth bottom fold line 160, respectively, to form a closed bottom portion 105, as shown in FIG. 7.

To form bottom portion 105, one of first bottom flap 144 and third bottom flap 148 is first folded along first bottom fold line 154 and third bottom fold line 158 such that the one of first bottom flap 144 and third bottom flap 148 is generally perpendicular to each of first side 114, second side 116, third side 118, and fourth side 120. The other of first bottom flap 144 and third bottom flap 148 is folded along the other of first bottom fold line 154 and third bottom fold line 158 such that the other of first bottom flap 144 and third bottom flap 148 overlaps the one of first bottom flap 144 and third bottom flap 148 and is generally perpendicular to each of first side 114, second side 116, third side 118, and fourth side 120. Next, second bottom flap 146 is folded along second bottom fold line 156 and overlaps first bottom flap 144 and third bottom flap 148. Fourth bottom flap 150 is then folded along fourth bottom fold line 160 and overlaps second bottom flap 146.

Each of first bottom flap 144, second bottom flap 146, third bottom flap 148, and fourth bottom flap 150 are illustrated as extending generally across an entire width of the respective first side 114, second side 116, third side 118, and fourth side 120. In one embodiment, one or more of first bottom flap 144, second bottom flap 146, third bottom flap 148, and fourth bottom flap 150 extends only partially across the width of first side 114, second side 116, third side 118, and fourth side 120. In one embodiment, one or more of first bottom flap 144, second bottom flap 146, third bottom flap 148, and fourth bottom flap 150 include multiple flaps. In one embodiment, at least one of first bottom flap 144, second bottom flap 146, third bottom flap 148, and fourth bottom flap 150 are not included and foldable component 106 includes only three or less bottom flaps.

Returning to FIG. 3, a first top flap 214, a second top flap 216, a third top flap 218, and a fourth top flap 220 extend from first side 114, second side 116, third side 118, and fourth side 120, respectively. First top flap 214, second top flap 216, third top flap 218, and fourth top flap 220 are foldable relative to first side 114, second side 116, third side 118, and fourth side 120 along first top fold line 224, second top fold line 226, third top fold line 228, and fourth top fold line 230, respectively.

Each of first top flap 214 and third top flap 218 are illustrated as extending generally about one-half of the length of second top flap 216 and fourth top flap 220. In one embodiment, each of first top flap 214, second top flap 216, third top flap 218, and fourth top flap 220 are generally the same length. In the illustrated embodiment, each of first top flap 214, second top flap 216, third top flap 218, and fourth top flap 220 extend across an entire width of the respective first side 114, second side 116, third side 118, and fourth side 120. In one embodiment, one or more of first top flap 214, second top flap 216, third top flap 218, and fourth top flap 220 extends only partially across the width of first side 114, second side 116, third side 118, and fourth side 120. In one embodiment, one or more of first top flap 214, second top flap 216, third top flap 218, and fourth top flap 220 include multiple flaps. In one embodiment, at least one of first top flap 214, second top flap 216, third top flap 218, and fourth top flap 220 are not included and foldable component 106 includes only three or less top flaps.

To form top portion 103, first top flap 214 and third top flap 218 are first folded along first top fold line 224 and third top fold line 228 such that first top flap 214 and third top flap 218 are generally perpendicular to each of first side 114, second side 116, third side 118, and fourth side 120. An edge 232 of first top flap 214 and an edge 234 of third top flap 218 are generally positioned proximate to each other. Next, fourth top flap 220 is folded along fourth top fold line 230 and overlaps first top flap 214 and second top flap 216. Fourth top flap 220 includes a cutout 234 which aligns with cutouts 236 and 238 in first top flap 214 and third top flap 218, respectively. Second top flap 216 is then folded along second top fold line 226 and overlaps fourth top flap 220. The flaps of top portion 103 are then generally secured in place. In one embodiment, adhesive is provided between the flaps. In one embodiment, tape 236 covers second top flap 216 and is secured to a portion of one or more of sides 108.

Second top flap 216 includes a flap 240 which is foldable relative to the remainder of second top flap 216 along fold line 242. A cutout 244 is provided in flap 240 to provide a handle whereby an operator may insert his finger to engage a lower surface of flap 240 to raise flap 240. In one embodiment, flap 240 is generally planer with second top flap 216 for transport and is raised to permit access to fillable bladder 104.

Returning to FIG. 2, the remainder of container 100 is illustrated. Container 100, in addition to fillable bladder 104 and enclosure 102, includes a sleeve 250, a plurality of corner posts 252, a sump member 254, a coupler 256, and a support 258. Sleeve 250 is also illustratively constructed from a single component 251. In the illustrated embodiment, sleeve 250 is made of paperboard. Other suitable materials include wood and plastic. The two vertical edges 253 and 255 of the single component 251 are held together through an adhesive tape 274.

Figure 6:
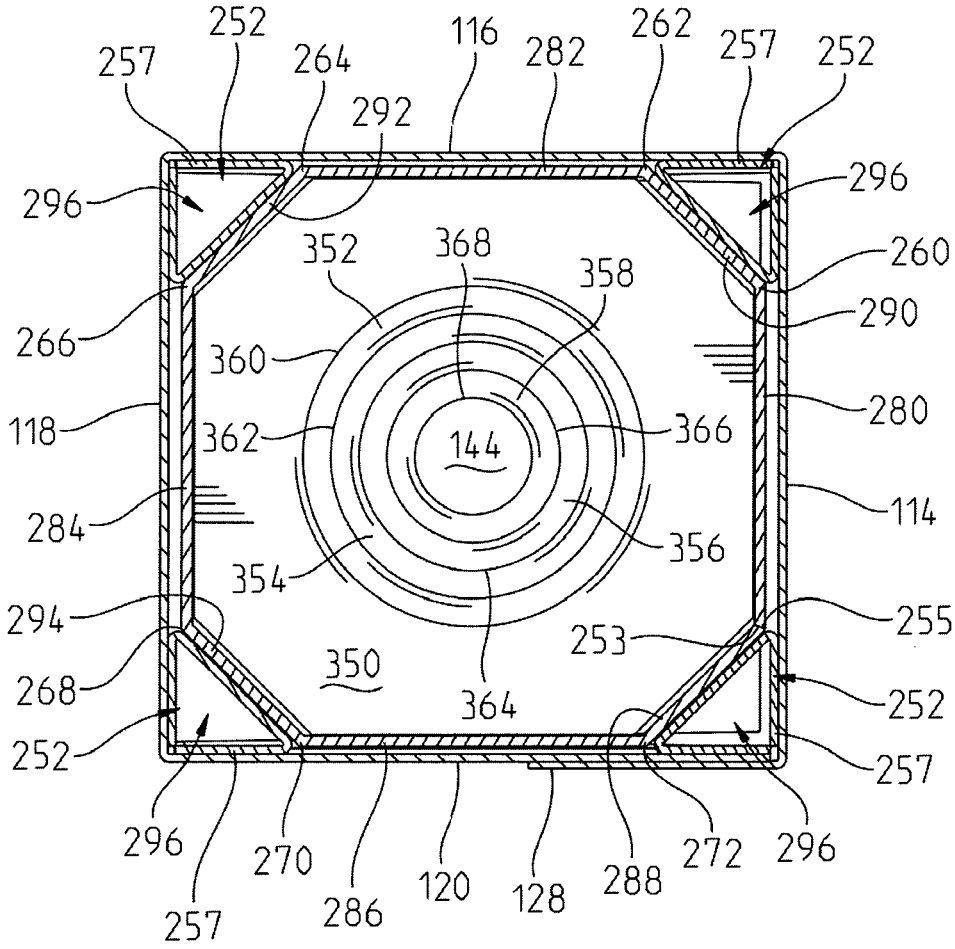
FIG. 6 illustrates a sectional view taken along lines 6-6 in FIG. 1 with the fillable bladder and dip stick removed.

Sleeve 250 includes seven fold lines 260-272 to create an eight sided sleeve. Other shapes of sleeve 250 are also possible. In one embodiment, sleeve 250 is a polygon. An exemplary polygon is the octagon illustrated in FIG. 2. In one embodiment, sleeve 250 is generally circular, generally elliptical, or another suitable non-faceted shape. In the illustrated embodiment, sleeve 250 is a non-regular octagon. Referring to FIG. 6, sleeve 250 includes sides 280-286 having a first width and sides 288-294 having a second width. In one embodiment, the first width of sides 280-286 is about 7.125 inches and the second width of sides 288-294 is about 5 inches. Sleeve 250 forms a boundary for fillable bladder 104 as generally shown in FIG. 7.

Container 100 includes four corner posts 252. Each of corner posts 252 is construed from a single foldable component 257. In the illustrated embodiment, corner posts 252 are made of paperboard. Other suitable materials include wood and plastic. Corner posts 252 are each folded to have a shape generally corresponding to a region 296 between enclosure 102 and sleeve 250, as shown in FIG. 6. Corner posts 252 provide stiffness to sleeve 250 to assist sleeve 250 from bulging outward in a radial direction, such as directions 296 and 298 (see FIG. 6).

Figure 2:
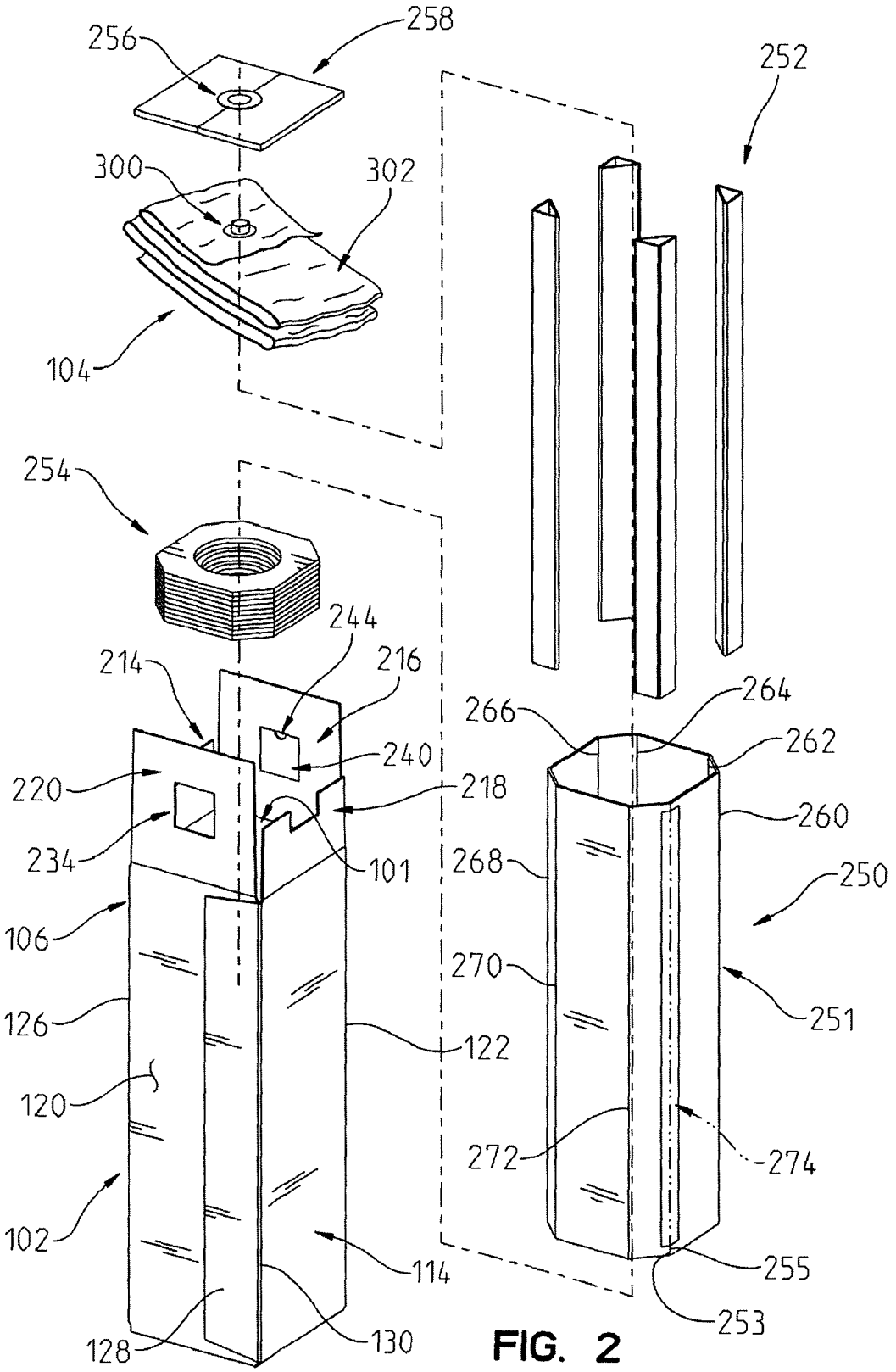
FIG. 2 illustrates an exploded view of the container of FIG. 1 with the fillable bladder in a folded configuration.

Referring to FIG. 2, fillable bladder 104 includes a neck portion 300. In one embodiment, neck portion 300 is a rigid member to which a foldable bladder portion 302 is coupled. In one embodiment, neck portion 300 is simply a portion of foldable bladder portion 302 which is a sleeve. Foldable bladder portion 302 is coupled to coupler 256.

Figure 4:
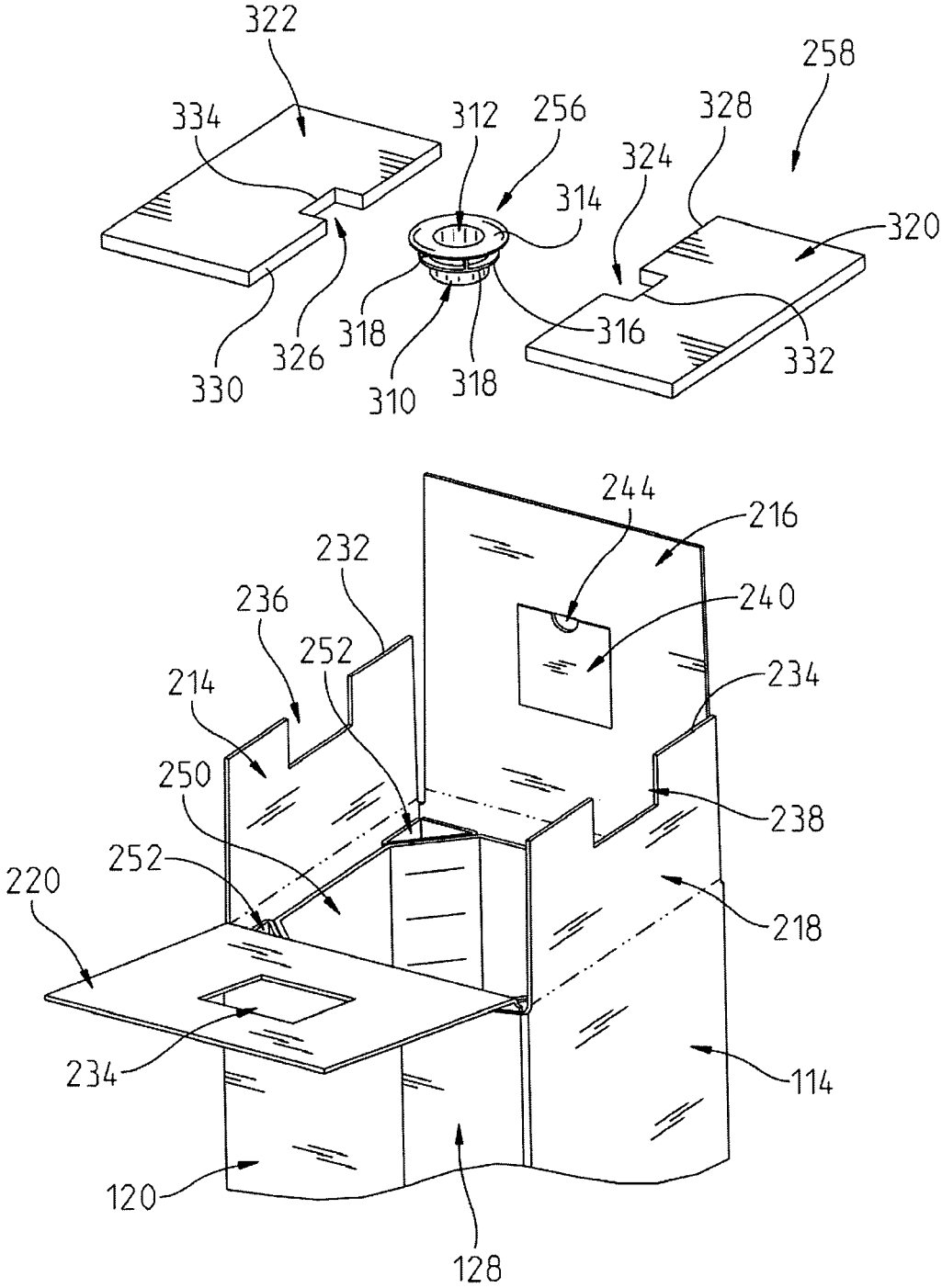
FIG. 4 illustrates a perspective view of a top portion of the enclosure shown with a sleeve member and corner posts placed therein and a support and a coupler being assembled together.

Referring to FIG. 4, coupler 256 includes a tubular body 310 having a fluid conduit 312. Tubular body 310 has a first flange 314 and a second flange 316 extending outward from tubular body 310. Second flange 316 is spaced apart from first flange 314. In the illustrated embodiment, first flange 314 is aligned with an end of tubular body 310. In one embodiment, first flange 314 and second flange 316 are spaced part from the ends of tubular body 310.

Referring to FIG. 7, first flange 314 and second flange 316 cooperate to capture portions of support 258 to minimize the movement of coupler 256 relative to support 258. Referring to FIG. 4, in the illustrated embodiment, support 258 includes a first support member 320 and a second support member 322. Each of first support member 320 and second support member 322 are shown being generally rectangular. First support member 320 and second support member 322 have a recess 324 and a recess 326, respectively. When first support member 320 and second support member 322 are brought together along edges 328 and 330, respectively, to capture coupler 256, edges 332 and 334 of first support member 320 and second support member 322, respectively, are proximate to tubular body 310 of coupler 256. Coupler 256 further includes a plurality of vertical ribs 318 which span from first flange 314 to second flange 316 to minimize the rotation of coupler 256 relative to support 258.

Each of first support member 320 and second support member 322 rests upon sleeve 250 and at least two of corner posts 252. In one embodiment, first support member 320 and second support member 322 are generally triangular with recesses 324 and 326 being normal to a hypotenuse of each triangle. When triangular in shape each of first support member 320 and second support member 322 rests upon sleeve 250 and three of corner posts 252. In one embodiment, first support member 320 and second support member 322 are made of about 0.625 inch plywood.

Referring to FIG. 7, a valve 340 is coupled to coupler 256. A dip tube 342 is coupled to valve 340 and extends down close to a bottom 344 of fillable bladder 104. An exemplary valve 340 is a DV-Drum Valve available from Micro-Matic located at 19791 Bahama Street in Northridge, Calif. 91324-33. Other valves may be used. An exemplary dip tube 342 is a flex dip tube also available from Micro-Matic located at 19791 Bahama Street in Northridge, Calif. 91324-33. A lower end 346 of dip tube 342 is shown positioned proximate bottom portion 105 of enclosure 102. As such, pumpable product 111 being held in fillable bladder 104 enters dip tube 342 through lower end 346 and rises up through dip tube 342 and exits through valve 340 as described herein.

Sump member 254 restricts the lateral extent of fillable bladder 104 near bottom portion 344 of fillable bladder 104 to position pumpable product 111 next to lower end 346 of dip tube 342 so that pumpable product 111 is removed through dip tube 342.

In one embodiment, sump member 254 is a single component positioned within enclosure 102. In one embodiment, sump member 254 is a part of enclosure 102. In one embodiment, sump member 254 is a plurality of components which are positioned within enclosure 102.

Figure 5:
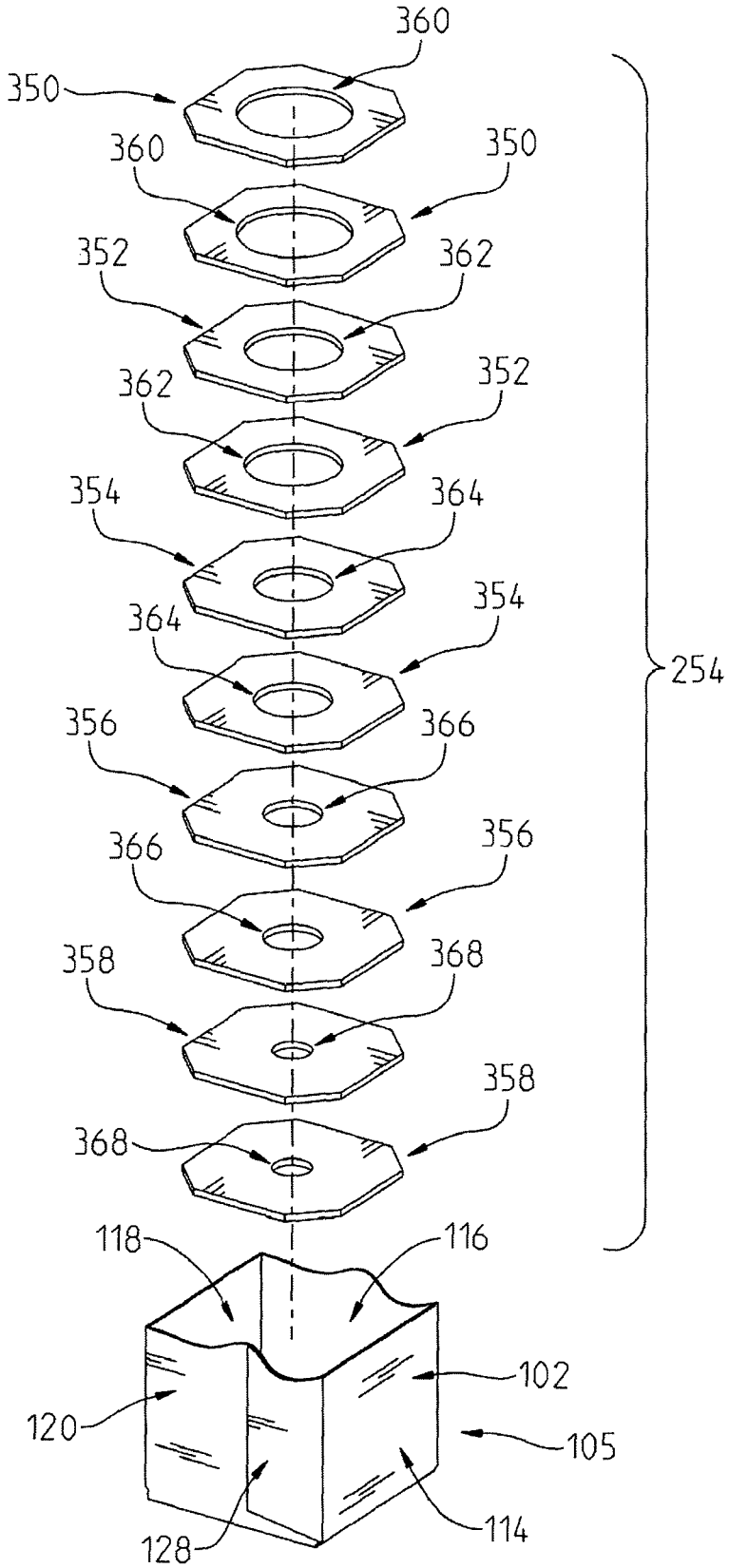
FIG. 5 illustrates an exploded view of a sump member which is to be positioned in a bottom portion of the enclosure.

Referring to FIG. 5, in the illustrated embodiment, sump member 254 includes a stack of individual members 350-358. Each of members 350-358 has an outer perimeter which generally matches the shape of sleeve 250. The members 350-358 are positioned within sleeve 250. In one embodiment, each of members 350-358 has an outer perimeter which generally matches the shape of enclosure 102 and sleeve 250 is supported on top of sump member 254.

Each of members 350-358 includes a respective opening 360-368. Openings 360-368 are centered in members 350-358 and when placed in sleeve 250 are centered in enclosure 102. The size of the openings 360-368 decrease. Openings 360-362 are shown as being circular in extent. In one embodiment, openings 360-362 are polygonal.

Referring to FIG. 7, the reduction in size of openings 360-368 causes fillable bladder 104 to neck down proximate to bottom portion 105 of enclosure 102. At a height 400 a horizontal cross-sectional area of fillable bladder 104 generally corresponds to the shape of sleeve 250. At a height 402 a horizontal cross-sectional area of fillable bladder 104 generally corresponds to the shape of opening 360 of member 350. At a height 404 a horizontal cross-sectional area of fillable bladder 104 generally corresponds to the shape of opening 362 of member 352. At a height 406 a horizontal cross-sectional area of fillable bladder 104 generally corresponds to the shape of opening 364 of member 354. At a height 408 a horizontal cross-sectional area of fillable bladder 104 generally corresponds to the shape of opening 366 of member 356. At a height 410 a horizontal cross-sectional area of fillable bladder 104 generally corresponds to the shape of opening 368 of member 358.

In one embodiment, opening 360 has a diameter of about 8 inches, opening 362 has a diameter of about 6.6875 inches, opening 364 has a diameter of about 5.375 inches, opening 366 has a diameter of about 4.0625 inches, and opening 368 has a diameter of about 2.75 inches. In one embodiment, the horizontal cross-sectional area of sleeve 250 is about 160 $in^2$. As such, the cross-sectional areas of opening 360 in member 350 is about 50 $in^2$ which is about 31 percent of the cross-sectional area of sleeve 250. The cross-sectional areas of opening 362 in member 352 is about 35 $in^2$ which is about 22 percent of the cross-sectional area of sleeve 250. The cross-sectional areas of opening 364 in member 354 is about 23 $in^2$ which is about 14 percent of the cross-sectional area of sleeve 250. The cross-sectional areas of opening 366 in member 356 is about 13 $in^2$ which is about 8 percent of the cross-sectional area of sleeve 250. The cross-sectional areas of opening 368 in member 358 is about 6 $in^2$ which is about 4 percent of the cross-sectional area of sleeve 250.

In one embodiment, container 100 is assembled as follows. Sides 108 of single foldable component 106 are folded as described herein and side flap 128 is coupled to fourth side 120. Bottom flaps 110 are folded as described herein and secured in place. Sleeve 250 is folded and placed into an interior of enclosure 102. Each of corner posts 252 are folded and placed in the region 296 between sleeve 250 and enclosure 102. Members 350-358 of sump member 254 are stacked and placed in bottom portion 105 of enclosure 102 as shown in FIG. 7. Fillable bladder 104 is coupled to coupler 256. Coupler 256 is captured between first support member 320 and second support member 322 of support 258. The assembly of coupler 256 with fillable bladder 104 and support 258 are placed in the interior of enclosure 102 and rests on top of sleeve 250 and corner posts 252. Fillable bladder 104 is expanded to generally fill the interior of sleeve 250 and sump member 254. Dip tube 342 is coupled to valve 340. Valve 340 is coupled to coupler 256. In one embodiment, coupler 256 and valve 340 include mating threads. Top flaps 112 of enclosure 102 are folded as described herein and secured in place.

Figure 8:
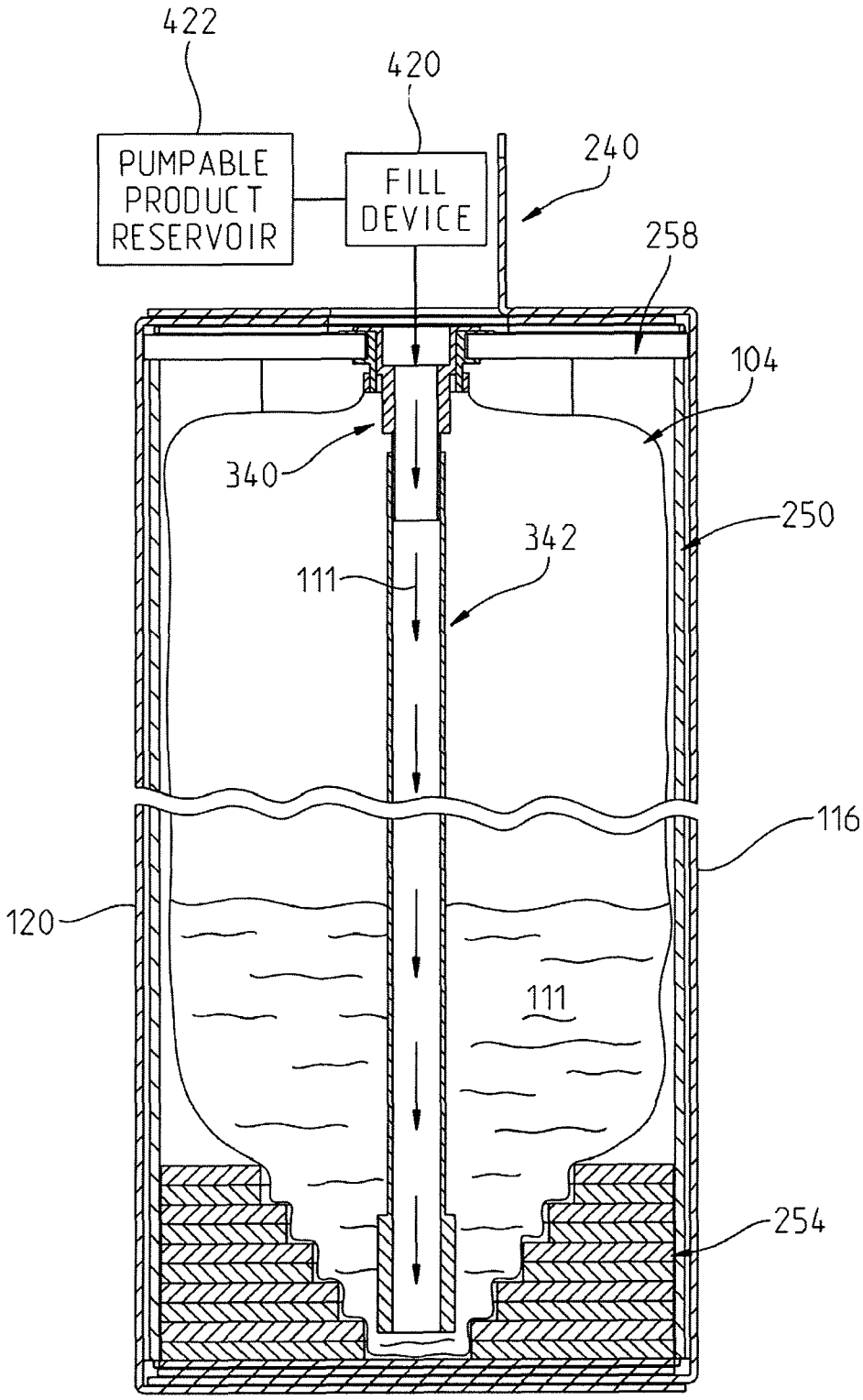
FIG. 8 illustrates the section view of FIG. 7 and a filling process of the fillable bladder.
Figure 9:
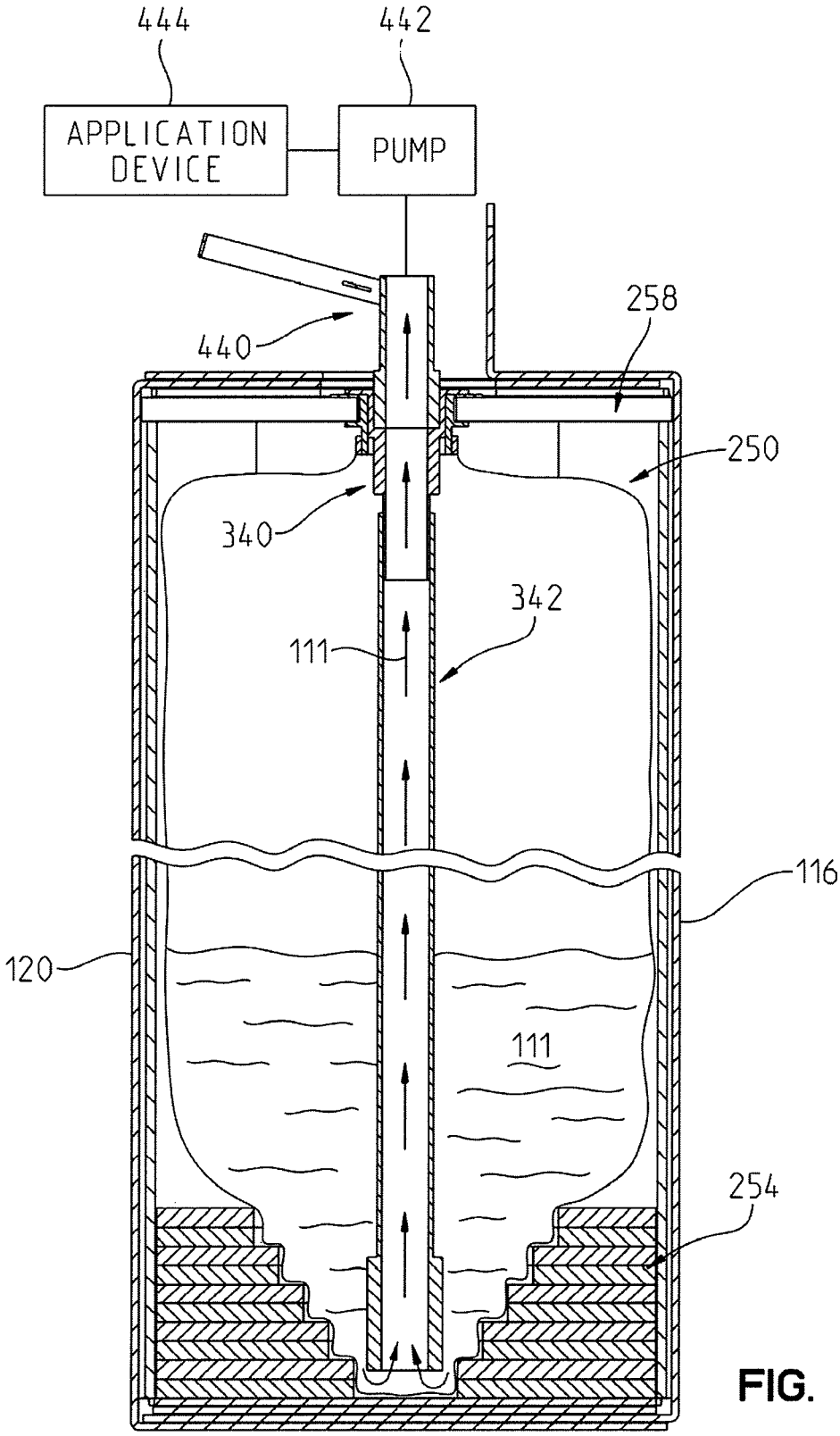
FIG. 9 illustrates the section view of FIG. 7 and an emptying process of the fillable bladder.

In one embodiment, fillable bladder 104 is filled as follows. Flap 240 of enclosure 102 is opened, as illustrated in FIG. 8. A fill device 420 is coupled to valve 340 and opens valve 340 such that an interior of fillable bladder 104 is in fluid communication with fill device 420. Fill device 420 is further in fluid communication with a pumpable product reservoir 422. Fill device 420 moves pumpable product 111 within pumpable product reservoir 422 to an interior of fillable bladder 104 through valve 340 and dip tube 342. In one embodiment, dip tube 342 is coupled to valve 340 and the valve 340 and dip tube 342 are inserted into bladder 104 after bladder 104 has been filled. In one embodiment, pumpable product 111 fills fillable bladder 104. In one embodiment, container 100 holds about 30 gallons (115 Liters) of pumpable product 111 when filled. When filling is complete, fill device 420 is uncoupled from valve 340. Valve 340 and dip tube 342 remain within the interior of enclosure 102. Flap 240 is closed. Enclosure 102 has shape of a parallelepiped when flap 240 is closed as generally shown in FIG. 7. The flat top 430 of container 100 and the flat bottom 432 of container 100 permit the stacking of container 100. The sleeve 250 and posts 252 also increase the top load strength of the container 100 allowing the stacking of multiple filled pallet loads for warehousing efficiency.

Container 100 is transported to a location whereat the pumpable product 111 within container 100 is to be emptied. To empty pumpable product 111 from container 100, flap 240 is opened and a fluid coupler 440 is coupled to valve 340. An exemplary fluid coupler is available from Micro-Matic located at 19791 Bahama Street in Northridge, Calif. 91324-33. Fluid coupler 440 is in fluid communication with a pump 442 which is in turn in fluid communication with an application device 444. An exemplary application device is a sprayer. Pump 442, through fluid coupler 440, removes pumpable product 111 from the interior of fillable bladder 104 through valve 340 and dip tube 342. Application device 444 provides pumpable product 111 for productive use. An exemplary productive use is spraying plant material in the case wherein pumpable product 111 is a herbicide.

Certain types of pumpable products require that the container in which they are transported needs to be rinsed multiple times to remove residue of the pumpable product from the container. This is to prevent unwanted application of the pumpable product in areas that the emptied containers are stored.

Container 100, once emptied, may be disposed of in the following manner. Fluid coupler 440 is uncoupled from valve 340. Support 258 is removed. In one embodiment, coupler 256 is removed at the same time. Coupler 256 is removed with valve 340, dip tube 342, and fillable bladder 104 still attached thereto. This arrangement of coupler 256, valve 340, dip tube 342, and fillable bladder 104 still forms a closed container for any residue of pumpable product 111. Enclosure 102, sleeve 250, corner posts 252, and sump member 254 may be disposed of since they were not in contact with pumpable product 111. In the illustrated embodiment, enclosure 102, sleeve 250, corner posts 252, and sump member 254 are paperboard based and may be left to degrade. In one embodiment, enclosure 102, sleeve 250, corner posts 252, and sump member 254 are passed through a chipper to break the components into smaller pieces which may be placed over the ground. In one embodiment, enclosure 102, sleeve 250, corner posts 252, and sump member 254 are paperboard based and may be recycled through recycle programs for paperboard.

Figure 10:
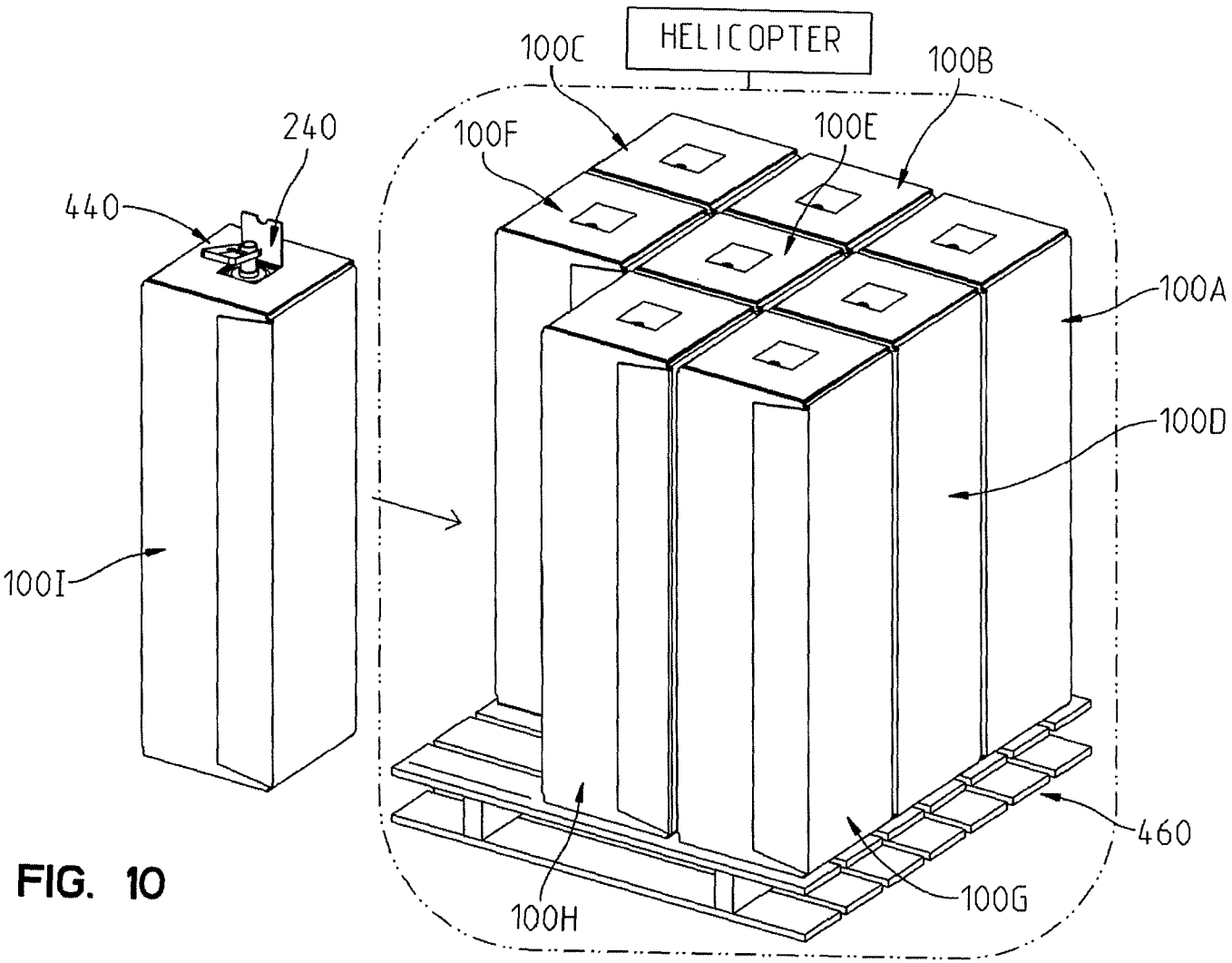
FIG. 10 illustrates the transportation of a plurality of containers on a pallet with a helicopter.

Referring to FIG. 10, container 100 may be placed side-by-side on a palette 460 or other suitable transport base. In one embodiment, palette 460 is about 44 inches square and nine containers 100 may be placed on palette 460. Each of bottom flaps 110 may carry about 30 gallons of pumpable product 111. As such, palette 460 may transport about 270 gallons of pumpable product 111 at one time. In one embodiment, pallet 460 and the nine containers 100 are surrounded by a net 462 or other securing device and supported from a helicopter 464 or other transport device. Other exemplary transport devices include a truck or ship wherein pallets with containers are placed in a storage portion of the truck or ship.

Further, since enclosure 102, sleeve 250, corner posts 252, and sump member 254 may be disposed of on site; palette 460 may transport many loads of containers 100 into a region and only make a single return trip with the leftover coupler 256, valve 340, dip tube 342, and fillable bladder 104 of the emptied containers 100. This reduces transportation costs and frees the up several return trips for other purposes.

While this disclosure has been described as having exemplary designs, the present disclosure can be further modified within the spirit and scope of this disclosure. For example, all of the disclosed components of the preferred and alternative embodiments are interchangeable providing disclosure herein of many systems having combinations of all the preferred and alternative embodiment components. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. A container, comprising:

an enclosure including a bottom portion, a top portion, and a plurality of sides which bound an interior of the enclosure, the enclosure including a sump region proximate the bottom portion of the enclosure, and a fillable bladder positioned within the enclosure, an interior of the fillable bladder being accessible through an opening in the enclosure proximate the top portion of the enclosure, a bottom portion of the fillable bladder being centered by the sump region under the opening in the enclosure proximate the top portion of the enclosure, wherein a first horizontal cross-sectional area of the fillable bladder located in the sump region of the enclosure is smaller than a second horizontal cross-sectional area of the fillable bladder, a perimeter of the first horizontal cross-sectional area of the fillable bladder is spaced apart from all of the plurality of side walls by the sump region, and the second horizontal cross-sectional area being above the first horizontal cross-sectional area and outside of the sump region of the enclosure.

2. The container of claim 1, wherein the sump region is formed by a plurality of components stacked together, each of the components having an opening provided therein that the fillable bladder extends into.

3. The container of claim 2, wherein a cross-sectional area of the opening of a first component of the plurality of components is smaller than a cross-sectional area of the opening of a second component of the plurality of components, the first component of the plurality of components being positioned between the bottom of the enclosure and the second component of the plurality of components.

4. The container of claim 3, wherein the openings in the plurality of components of the sump region are circular.

5. The container of claim 3, wherein the cross-sectional area of the first component of the plurality of components is about 12 percent of the cross-sectional area of the second component of the plurality of components.

6. The container of claim 3, wherein the cross-sectional area of the first component of the plurality of components is less than about 50 percent of the cross-sectional area of the second component of the plurality of components.

7. The container of claim 1, further comprising a sleeve member which is positioned between the fillable bladder and the enclosure, the sleeve member keeping the fillable bladder spaced apart from the plurality of sides of the enclosure.

8. The container of claim 7, wherein a plurality of gaps are provided between the sleeve member and the plurality of sides of the enclosure.

9. The container of claim 8, wherein a plurality of posts are positioned in the plurality of gaps to strengthen the sleeve member.

10. The container of claim 9, wherein the plurality of gaps are positioned in a plurality of corners formed by the plurality of sides of the enclosure.

11. The container of claim 10, wherein the plurality of sides of the enclosure form a quadrilateral within a horizontal plane and the sleeve member is an octagon within the horizontal plane.

12. The container of claim 11, wherein the sleeve member is a non-regular octagon within the horizontal plane.

13. The container of claim 12, wherein the enclosure and the sleeve member are made of paperboard.

14. The container of claim 13, wherein the fillable bladder is suspended from a support member which rests on top of the sleeve member.

15. The container of claim 13, wherein the sump region is formed by a plurality of components stacked together, each of the components having an opening provided therein that the fillable bladder extends into.

16. The container of claim 15, wherein a cross-sectional area of the opening of a first component of the plurality of components is smaller than a cross-sectional area of the opening of a second component of the plurality of components, the first component of the plurality of components being positioned between the bottom of the enclosure and the second component of the plurality of components.

17. The container of claim 15, wherein the openings in the plurality of components of the sump region are circular.

18. The container of claim 16, wherein the cross-sectional area of the first component of the plurality of components is about 12 percent of the cross-sectional area of the second component of the plurality of components.

19. The container of claim 16, wherein the cross-sectional area of the first component of the plurality of components is less than about 50 percent of the cross-sectional area of the second component of the plurality of components.

20. The container of claim 16, wherein the plurality of components are positioned within the sleeve member.

21. The container of claim 20, wherein the plurality of components are made of paperboard.

22. The container of claim 1, wherein a pumpable product which enters the interior of the fillable bladder is dispensed from the interior of the fillable bladder only through the opening in the enclosure proximate the top portion of the enclosure.

23. A container, comprising:

an enclosure including a bottom portion, a top portion, and a plurality of sides which bound an interior of the enclosure, the enclosure including a sump region proximate the bottom portion of the enclosure, wherein the sump region is formed by a plurality of components, each component having an outer perimeter which generally matches the shape of the bottom portion of the enclosure, and a fillable bladder positioned within the enclosure, an interior of the fillable bladder being accessible only through an opening in the enclosure proximate the top portion of the enclosure, wherein a first horizontal cross-sectional area of the fillable bladder located in the sump region of the enclosure is smaller than a second horizontal cross-sectional area of the fillable bladder, the second horizontal cross-sectional area being above the first horizontal cross-sectional area and outside of the sump region of the enclosure.

24. The container of claim 23, wherein the sump region positions a bottommost portion of the fillable bladder under the opening in the enclosure proximate the top portion of the enclosure.

25. The container of claim 23, wherein the sump region is centered in the enclosure.

26. The container of claim 23, further comprising:

a removable internal sleeve having a plurality of sides and configured to receive the fillable bladder, the sleeve being positioned within the interior of the enclosure and providing at least one space between the plurality of sides of the enclosure and the plurality of sides of the sleeve; and at least one post received within the at least one space.

27. The container of claim 26, wherein a horizontal plane of the sleeve is configured as a polygon having eight sides.

28. The container of claim 27, wherein a first group of four sides of the polygon has a first width and a second group of four sides of the polygon has a second width, the first width being greater than the second width.

29. The container of claim 26, wherein the sleeve is comprised of paperboard.

30. The container of claim 26, wherein the sleeve and the plurality of components of the sump region form a boundary for the fillable bladder.

31. The container of claim 30, wherein a bottom portion of the fillable bladder is centered by the sump region under the opening in the outer enclosure.

32. The container of claim 30, wherein the sleeve is formed by folding a single component of the paperboard.

33. The container of claim 26, wherein the plurality of sides of the enclosure includes four corners.

34. The container of claim 27, wherein a post is positioned adjacent each of the four corners of the enclosure.

35. The container of claim 26, wherein the at least one post has a shape and a size substantially similar to a shape and a size of the at least one space.

36. The container of claim 35, wherein the at least one post is comprised of paperboard.

37. The container of claim 36, wherein the at least one post is formed by folding a single component of the paperboard.

38. A container, comprising:

an outer enclosure having a top portion, a bottom portion, and a plurality of sides bounding an interior region, the outer enclosure further including a sump region, the sump region having a top surface perpendicular to the plurality of sides and a bottom surface centered in the outer enclosure, the sump region having a stair step profile between the bottom surface and the top surface;

a fillable bladder received within the interior region of the enclosure and including a neck portion coupled to a bladder portion, the bladder portion being configured to house a pumpable product; and a support internal to the outer enclosure, the support holding the neck portion of the fillable bladder intermediate the bladder portion of the fillable bladder and the top portion of the enclosure.

39. The container of claim 38, wherein the container includes a sleeve, the support being supported by the sleeve.

40. The container of claim 38, further comprising a plurality of posts positioned intermediate the enclosure and the fillable bladder, the support supported by the plurality of posts.

41. The container of claim 38, wherein the support is comprised of plywood.

42. A container, comprising:

an outer enclosure having a top portion, a bottom portion, and a plurality of sides bounding an interior region, the outer enclosure including a sump region proximate the bottom portion of the outer enclosure, a fillable bladder received within the interior region of the outer enclosure and including a neck portion coupled to a bladder portion, the bladder portion being configured to house a pumpable product; and a support internal to the outer enclosure, the support holding the neck portion of the fillable bladder intermediate the bladder portion of the fillable bladder and the top portion of the enclosure, wherein the support includes a first member and a second member generally surrounding the neck portion of the fillable bladder, a bottom portion of the fillable bladder being centered by the sump region under the opening in the outer enclosure proximate the top portion of the outer enclosure, wherein a first horizontal cross-sectional area of the fillable bladder located in the sump region of the outer enclosure is smaller than a second horizontal cross-sectional area of the fillable bladder, a perimeter of the first horizontal cross-sectional area of the fillable bladder is spaced apart from all of the plurality of side walls by the sump region, and the second horizontal cross-sectional area being above the first horizontal cross-sectional area and outside of the sump region of the outer enclosure.

43. The container of claim 42 wherein each of the first and second members are supported by a sleeve and at least two of a plurality of posts.

* * * * *